United States Patent [19]

Weinstein

[11] Patent Number: 4,997,130

[45] Date of Patent: Mar. 5, 1991

[54] AIR BEARING ROTARY ATOMIZER

[75] Inventor: Richard Weinstein, Toledo, Ohio

[73] Assignee: Illinois Tool Works, Inc., Glenview, Ill.

[21] Appl. No.: 449,380

[22] Filed: Dec. 6, 1989

Related U.S. Application Data

[63] Continuation of Ser. No. 879,082, Jun. 26, 1986, abandoned.

[51] Int. Cl.[5] ..... B05B 3/02

[52] U.S. Cl. ..... 239/222; 239/224; 239/424; 239/700

[58] Field of Search ..... 239/222, 223, 224, 214.11, 239/214.19, 293, 424, 700, 701, 702, 703

[56] References Cited

U.S. PATENT DOCUMENTS

| | | | |
|---|---|---|---|
| 4,018,554 | 4/1977 | Teodoruscu | 431/188 |
| 4,337,895 | 7/1982 | Gallen | 239/7 |
| 4,380,321 | 4/1983 | Culbertson et al. | 239/700 |
| 4,405,086 | 9/1983 | Vetter . | |
| 4,423,840 | 1/1984 | Coeling . | |
| 4,505,430 | 3/1985 | Rodgers et al. | 239/223 |
| 4,555,058 | 11/1985 | Weinstein et al. . | |
| 4,572,437 | 2/1986 | Huber et al. | 239/703 |
| 4,643,357 | 2/1987 | Culbertson et al. | 239/223 |

FOREIGN PATENT DOCUMENTS

| | | | |
|---|---|---|---|
| 0104394 | 4/1984 | European Pat. Off. . | |
| 0292679 | 11/1988 | European Pat. Off. . | |
| 1240764 | 5/1967 | Fed. Rep. of Germany . | |
| 922212 | 6/1945 | France . | |
| 978637 | 4/1951 | France . | |
| 58-92475 | 6/1983 | Japan . | |
| 8605418 | 9/1986 | PCT Int'l Appl. | 239/223 |
| 2068150 | 10/1980 | United Kingdom . | |
| 2068152 | 1/1981 | United Kingdom . | |
| 2097291 | 3/1982 | United Kingdom . | |
| 2137904 | 10/1984 | United Kingdom . | |
| 2147524 | 5/1985 | United Kingdom . | |

*Primary Examiner*—Kenneth J. Dorner
*Assistant Examiner*—Gerald A. Anderson
*Attorney, Agent, or Firm*—Macmillan, Sobanski & Todd

[57] ABSTRACT

A rotary atomizer includes a manifold assembly adapted to be attached to a mechanism for moving the atomizer and an air bearing turbine motor housing assembly releasably secured to the manifold assembly. Sources of pressured fluid for actuating the atomizer and coating fluid are connected to the manifold which has fittings for releasably sealing to apertures in the rear cover of the housing assembly. The opposite end of the housing includes a shaping air cap and a shaping air ring which cooperate to define an annulus for discharging a thin ring of shaping air over the peripheral edge of an atomizer bell to direct fluid particles toward a target. Exhaust air from the turbine motor is vented to the inside of the housing and directed to a chamber behind the atomizer bell to aid in directing the fluid particles. A magnetic speed pickup generates a signal which is coupled through a circuit that electrically isolates the high voltage which is applied to the atomizer to electrically charge the coating particles.

13 Claims, 2 Drawing Sheets

AIR BEARING ROTARY ATOMIZER

The invention relates generally to rotary atomizers for depositing coatings on workpieces and, in particular, to a rotary atomizer with improved flow of the coating material through the atomizer and onto the workpiece.

BACKGROUND OF THE INVENTION

One type of prior art device utilized to apply coatings to workpieces is a rotary atomizer. Such a device is particularly useful in coating large surfaces in high volume such as the painting of automobile bodies and the like. A disk or a bell is driven in rotation by an air-powered turbine motor. Paint is delivered to the inner surface of the disk or bell and is thrown off in small particles through centrifugal force. Typically, the surface of the bell is charged to a high voltage normally between 30 KV and 125 KV to electrostatically charge the paint particles.

One form of rotary atomizer is disclosed in U.S. Pat. No. 4,555,058. This device has a bell which is rotated at high speeds, normally between 10,000 and 40,000 rpm. The rotary bell has a plurality of paint openings formed therein connected to a source of paint. Air under pressure is forced through another plurality of openings in a front plate to direct shaping air over the outside of the bell to thereby shape the stream of paint particles exiting from the bell and direct them toward the object to be painted.

U.S. Pat. No. 4,423,840 discloses an ultra high-speed rotary atomizer bell designed to eliminate foam or bubbles in the applied coating. As the bell is rotated at high speed, centrifugal force causes the paint to flow through distribution apertures to a generally conical interior flow surface on the discharge side of the bell. Centrifugal force also causes the paint to flow along the conical interior surface in a continuous film to a sharp discharge edge between the conical surface and the front end of the bell. The front end of the bell has a predetermined wall thickness and forms a sharp discharge edge at the interior surface and is rounded at the exterior surface. By rounding the discharge end on the exterior surface, the entrapped air or other cause of bubbles in the applied coating is eliminated, even though the rotary atomizer bell is operated at extreme speeds which may be on the order of 40,000 rpm, or more.

SUMMARY OF THE INVENTION

The present invention concerns a rotary atomizer including a manifold releasably connected to an outer casing or shroud housing an air bearing turbine assembly. The manifold includes inlets for sources of bearing air, brake air, shaping air, turbine air, and coating fluid, as well as an aperture for a magnetic speed pickup coil connection. A larger diameter end of the outer casing or shroud is closed by a rear cover plate having a plurality of aperatures formed therein for sealingly accepting corresponding fittings protruding from a facing surface of the manifold and connected to the air inlets.

The coating fluid is directed through a centrally located fluid feed tube that extends through the air turbine motor and terminates in a nozzle located in a paint chamber formed by the forward end of the air turbine motor, an atomizer bell, and an annular shaping air cap. The feed tube has a rear flange which mounts into an aperture in the rear cover plate for precise alignment with the turbine driven motor shaft.

The smaller diameter end of the shroud receives the shaping air cap and an annular shaping air ring which are threadably engaged. Nesting tapers formed on inner surfaces of the cap and ring define a shaping air annulus which directs shaping air over the outer edge of the atomizer bell in an inwardly directed path as a uniform thin rng of air.

A flexible cap retainer is mounted on the front cover of the air turbine motor to separate the shaping air passage from the exhaust air passage. The cap retainer also provides an elastic containment to retain the shaping air cap should it become disengaged from the shaping air manifold to which it is threadably engaged.

Exhaust air exits the rear of the turbine and is ported into the shroud where it flows forward along the outside of the turbine to provide cooling and then it is directed into the chamber between the shaping air cap and the rear of the atomizer bell from which it exits through the annulus formed between the outer edge of the bell and the front edge of the cap. This air prevents the coating fluid from wrapping back around the outside of the shroud and from entering the chamber. This use of the exhaust air reduces the amount of shaping air required and also reduces the cleaning required. Furthermore the volume of the exhaust air inherently increases as the speed of the air turbine increases to offset the radial momentum of the coating fluid particles.

A pickup coil is located adjacent the path of magnets mounted on the rear of the turbine wheel in the motor and is connected to a loop of high voltage wire. The wire extends away from the atomizer and through a toroidal coil to isolate the magnetically generated speed signal from the high voltage used with the atomizer.

BRIEF DESCRIPTION OF THE DRAWINGS

The aforementioned advantages of the invention will become manifest to one skilled in the art from reading the following detailed description of what is now considered to represent its best embodiment when considered in the light of the accompanying drawings, in which.

DETAILED DESCRIPTION OF THE PREFERRED EMBODIMENT

Figure 1:
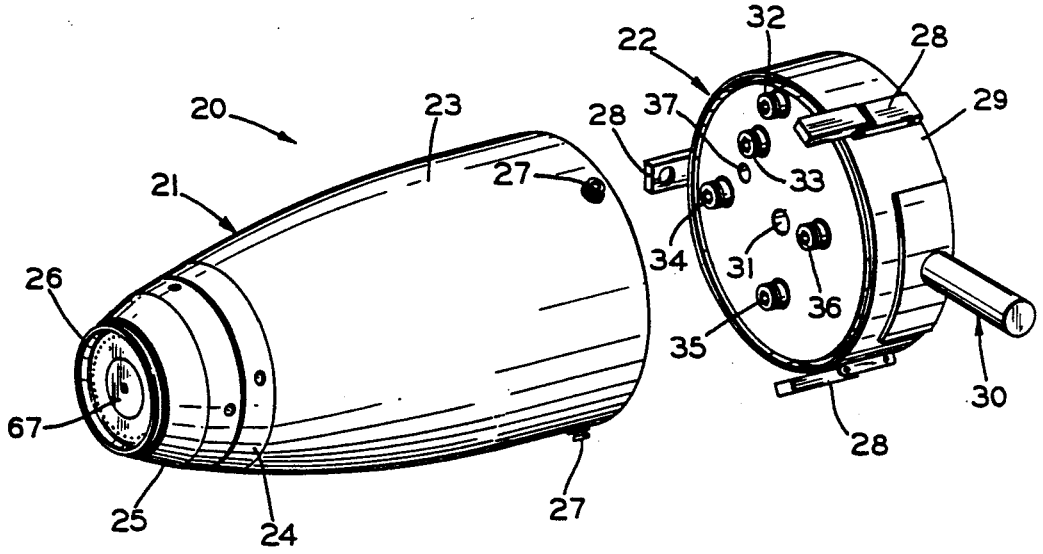
FIG. 1 is an exploded perspective view of a rotary atomizer according to the present invention.

A rotary atomizer 20 according to the present invention includes a housing assembly 21 which can be releasably secured to a manifold assembly 22. The housing assembly 21 includes an outer casing or shroud 23 having a larger diameter end for attachment to the manifold assembly 22 and tapering to an opposite smaller diameter front end. Abutting the opening in the smaller diameter end of the shroud 23 is an annular shaping air cap 24. Attached to the cap 24 is an annular shaping air ring 25 which forms an opening in which is centered an atomizer bell 26.

The housing assembly 21 can be releasably attached to the manifold assembly 22 by a plurality of latches having a first portion 27 attached to an outer surface of the shroud 23 and a second portion 28 attached to an outer surface of the manifold assembly 22. As shown, three generally equally spaced latching mechanisms are utilized, but any convenient number and spacing of conventional latching mechanisms are suitable. The manifold assembly 22 includes a generally cylindrical manifold body 29 to which the second latch portions 28 are affixed to the outer curved surface thereof. Also attached to the curved surface of the manifold body 29 is a radially extending stud assembly 30 for attachment to a device for positioning the rotary atomizer 20 at a work station such as an industrial robot or reciprocating mechanism (not shown).

The manifold body 29 has a central aperture 31 formed therein for the delivery of coating fluid to the housing assembly 21 as will be discussed below. Also, a plurality of fittings extend from the surface of the manifold body 29 which faces the larger diameter end of the shroud 23. These fittings include a shaping air fitting 32, an exhaust air fitting 33, a bearing air fitting 34, a turbine air fitting 35 and a brake air fitting 36. Also formed in the manifold body 29 is a speed monitor access port 37 utilized to carry signals representing the speed of the air turbine motor. For example, the air turbine motor can be fitted with a magnetic pickup for generating pulses representing the revolutions of the turbine. Signal-carrying wires from the pickup can be extended through the access port 37 to a high voltage isolation device and then to suitable monitoring and display equipment (not shown).

Figure 2:
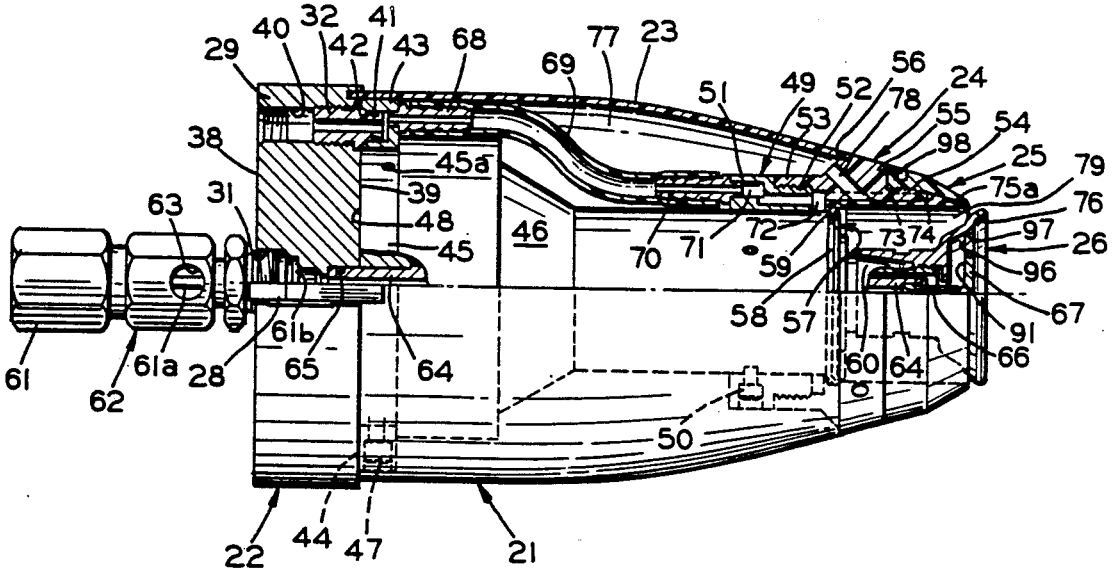
FIG. 2 is a side elevational view in partial cross-section of the rotary atomizer shown in FIG. 1.

The rotary atomizer 20 of FIG. 1 is shown in a fragmentary, cross-sectional side elevational view in FIG. 2. The housing assembly 21 and the manifold assembly 22 are shown connected by the first latch portions 27 and the second latch portions 28. The manifold body 29 has an outer planar face 38 and a generally parallel inner planar face 39 between which extend a plurality of apertures forming passages for the various fluids which are supplied to the housing assembly 21. An aperture 40 is representative of five such passages, one for each of the shaping air, exhaust air, bearing air, turbine air, and brake air. The end of the passageway 40 adjacent the face 38 is threaded to receive a connection to a source of shaping air (not shown). Typically, a conventional source of pressured air is connected to a line having a threaded fitting on the end thereof to threadably engage the passageway 40. The end of the passageway 40 adjacent the inner planar face 39 is also threaded and threadably receives one end of the fitting 32.

The protruding end of the fitting 32 retains an "O" ring 41 in a suitable groove and extends into an aperture 42 formed in a mounting ring 43 which extends around the inner periphery of the larger diameter end of the shroud 23. A planar face 44 of the mounting ring 43 abuts the face 39 of the manifold body 29. The opening of the aperture 42 to the face 44 is tapered so as to guide the fitting 32 and the "O" ring 41 into the aperture 42 whereupon the "O" ring seals against the walls of the aperture 42. Thus, the manifold body 29, the fitting 32, the "O" ring 41 and the mounting ring 43 cooperate to seal the shaping air path from its source through the manifold assembly 22 and into the housing assembly 21. A sealed path for each of the brake air, exhaust air, turbine air, and bearing air is formed in a similar manner to the rear cover of the housing. When the latch portions 27 and 28 are released, the housing assembly 21 can be easily separated from the manifold assembly 22 which can remain attached to the robot or reciprocator.

The mounting ring 43 engages a flange 45 formed on one end of an air bearing turbine motor 46. The mounting ring 43 is attached to the motor 46 with one or more threaded fasteners 47 extending through a radial aperture formed in the mounting ring 43 and into threaded engagement with a threaded aperture formed in the flange 45. A plurality of apertures (not shown) are formed in a rear cap 48 of the motor within the center area of the ring 43 and receive the protruding ends of the fittings 33, 34, 35 and 36. Thus, the end cover 48 and the ring 43 cooperate as a rear cover plate for the shroud 23. The opposite end of the turbine motor 46 extends through an annular shaping air manifold 49. The shaping air manifold 49 is attached to the motor 46 with one or more threaded fasteners 50 extending through a radial aperture formed in the manifold 49 and into threaded engagement with a threaded aperture in the outer surface of the motor 46.

The radially extending aperture for the fastener 50 is formed in a larger diameter portion 51 of the manifold 49. The larger diameter portion 51 is connected to a smaller diameter portion 52 which is located closer to the forward end of the motor 46. The smaller diameter portion 52 has external threads formed thereon for engaging internal threads formed on an inner surface of the annular shaping air cap 24. The cap 24 includes a smaller diameter rear portion 53, which threadably engages the portion 52 of the manifold 49, and a smaller diameter front portion 54 connected on opposite sides of a larger diameter central portion 55. A rearwardly facing outer edge of the central portion 55 has a circumferential notch 56 formed therein for engaging and retaining a leading edge of the shroud 23. The smaller diameter front portion 54 has external threads formed thereon for engaging internal threads formed on an inner wall of the annular shaping air ring 25.

The turbine motor 46 includes a front cover plate 57 which cooperates with the motor housing to form a radially extending groove 58. The groove 58 retains an inner edge of a flexible annular shaping air cap retainer 59. An outer edge of the cap retainer 59 engages an inner surface of the shaping air cap 24. Extending from the cover plate 57 is a forward end of a threaded drive shaft 60 upon which is mounted the atomizer bell 26.

A source of pressured air (not shown) is connected to the piston chamber of a conventional fluid valve 61 which in turn is connected to a valve fluid assembly 62. The valve fluid assembly 62 includes one or more radially extending threaded apertures 63 for connection to a source of coating fluid (not shown). The valve fluid assembly 62 extends into and is threadably engaged in the central aperature 31 formed in the manifold body 29. The valve piston assembly 61 includes a stem 61*a* which extends through the valve fluid assembly 62 and terminates in a sealing element 61*b* which cooperates with a sealing surface formed in the aperture 31. Thus, when air pressure exceeding a predetermined value is applied to the valve 61, the valve will open to admit the coating fluid from the valve fluid assembly 62 thereby forcing coating fluid through the central aperture 31 in the manifold assembly 22. The end of the central aperture 31 adjacent the face 39 receives one end of a rigid fluid feed tube or line 64. The fluid line 64 retains an "O" ring 65 in an external "O" ring groove to seal against the inner surface of the central aperture 31. The fluid line 64 extends through the flange 45, the center of the fluid motor 46 and the drive shaft 60 and terminates at the forward end of the drive shaft. Attached to and extending from the interior of the fluid line 64 is a fluid nozzle 66. The atomizer bell 26 has a central aperture formed therein which is closed by a circular splash plate 67. As will be discussed below, the splash plate 67 has an inwardly facing conical center which extends into the open end of the fluid nozzle 66 which end is internally tapered to match the taper on the splash plate 67.

The aperture 42 in the mounting ring 43 is connected to one end of a barbed fitting 68. The barbed end of the fitting 68 is inserted into one end of a length of flexible tubing 69. A second barbed fitting 70 has its barbed end inserted into the opposite end of the piece of tubing 69. The barbed fitting 70 is connected to an aperture 71 formed in the larger diameter portion 51 of the shaping air manifold 49. The aperture 71 extends longitudinally through the shaping air manifold 49 and is open to an annular cavity 72 defined by the shaping air manifold 49, the shaping air cap 24, the shaping air cap retainer 59 and the housing of the turbine motor 46. A longitudinally extending passageway 73 is formed through the smaller diameter front portion 54 and the larger diameter central portion 55 of the shaping air cap 24 to connect the cavity 72 with a cavity 74 formed between the exterior surface of the smaller diameter front portion 54 of the shaping air cap 24 and the interior surface of the shaping air ring 25.

As the shaping air ring 25 is threaded onto the shaping air cap 24, the outer surface of the shaping air ring 25 forward of the cavity 74 will engage or abut the inner surface of the forward end of the shaping air cap 24 to prevent the shaping air from exiting from the cavity 74. However a plurality of grooves or slots 75 (shown in FIG. 4) are formed in the outer surface of the forward end of the front portion 54 and are generally equally spaced about the periphery. These slots 75 permit the shaping air to exit the cavity 74 between the cap 24 and the ring 25 and flow into an annular space **75*a* between the spaced apart forward ends of the cap 24 and the ring 25. The cavity 74 and the slots 75 cooperate to distribute the air to the annular space 75*a* uniformly about the perimeter of the bell 26. The shaping air exits the annular space 75*a* at the forward edges thereof adjacent an outer edge 76 of the atomizer bell 26. The slots 75 are formed at an angle to the longitudinal axis of the housing assembly 21 to provide an inwardly directed stream of shaping air about the circumferential edge 76. The slots 75 and the annular space 75*a* deliver the shaping air as a thin ring to offset the momentum of the atomized coating fluid particles which escape in a radial direction from the edge of the bell 26. The inwardly directed shaping air provides a small pattern and greater efficiency to the shaping air for controlling the radial pattern of the atomized fluid. The angled surface in which the slots 75 are formed and the abutting surface on the ring 25 are conical about the axis for the bell 26 to precisely align the ring 25 on the air cap 24. This construction assures that the annular space 75*a* will be uniform about the axis to provide a uniform flow of shaping air about the bell 26**.

The exhaust air from the turbine motor 46 is normally expelled from an aperture (not shown) in the planar end 48, into the fitting 33 and through the manifold body 29 to an exhaust air line (not shown). However, the exhaust air can be expelled from one or more apertures **45*a* in the flange 45 into a cavity 77 formed between the motor 46 and the shroud 23. A passageway 78 extends through the larger diameter central portion 55 of the shaping air cap 24 to connect the cavity 77 with a cavity or chamber 79 formed between the inner surface of the shaping air cap 24 and the outer surface of the atomizer bell 26. The retainer 59 extends between the shaping air cavity 72 and the exhaust air chamber 79 to prevent the flow of air therebetween. As the exhaust air passes through the cavity 77, it cools the turbine motor 46 and reduces the heat generated by the internally mounted air bearings. The exhaust air exits the cavity 79 between the forward end of the shaping air cap 24 and the outer edge 76 of the atomizer bell 26 to aid the shaping air exiting the annular space 75*a*. This air prevents coating fluid from wrapping back around the outside of the shroud 23 as well as entering the chamber 79. Also, since the exhaust air exits in a forward direction, it reduces the amount of shaping air required to drive the coating fluid toward the target. Also, more shaping air is normally required to offset the increased momentum of the coating particles as the atomizer speed increases. Since the volume of exhaust air increases as the speed of the turbine motor 46** increases, the exhaust air helps to meet the need for more shaping air.

Figure 3:
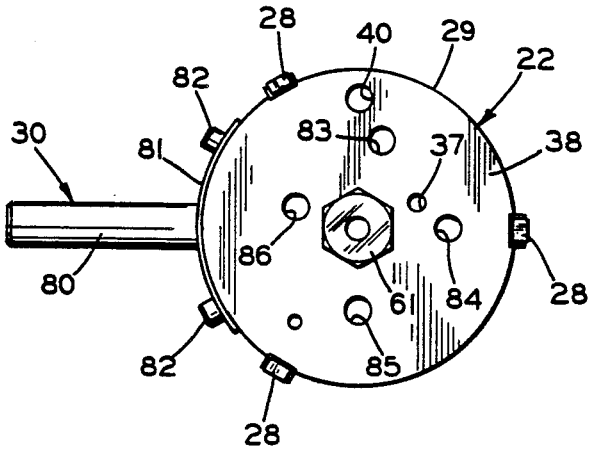
FIG. 3 is a rear elevational view of the rotary atomizer shown in FIG. 1.

In FIG. 3, the surface 38 of the manifold body 29 and the stud assembly 30 are shown in more detail. The stud assembly 30 includes a generally cylindrical post 80 extending in a radial direction from a semi-circular mounting bracket 81 secured to the outer circumferential surface of the manifold body 29 by a pair of fasteners 82. As stated above, the stud assembly 30 is adapted to be attached to an arm of a robot or a reciprocator. Also shown in FIG. 3 are the threaded passageway 83 for connection to an exhaust line, a threaded passageway 84 for connection to a source of bearing air, a threaded passageway 85 for connection to a source of turbine air, and a threaded passageway 86 for connection to a source of brake air. The exhaust aperture 83 can be blocked or provided with a restrictor valve (not shown) to direct the exhaust air into the cavity 77.

Figure 4:
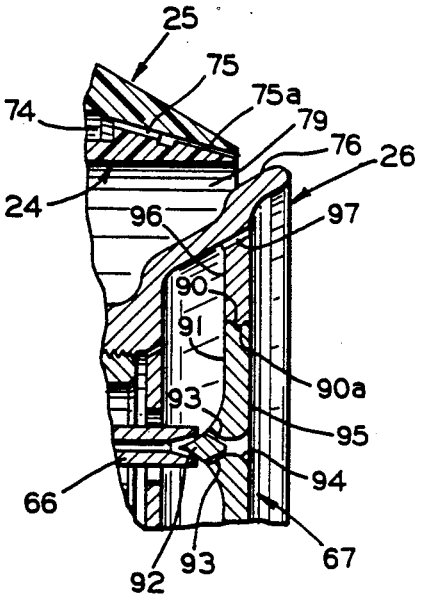
FIG. 4 is an enlarged, fragmentary, cross-sectional side elevational view of the front end of the rotary atomizer of FIG. 1.

FIG. 4 is a fragmentary side elevational view of the forward ends of the cap 24, the ring 25, the bell 26, and the splash plate 67 and a portion of the cavity or chamber 79 of FIG. 2 in cross-section. The body of the splash plate 67 is disk-shaped with a V-shaped groove 90 formed in the circumferential edge thereof. The groove 90 engages a radially extending flange **90*a* formed in the opening in the atomizer bell 26. Thus, the splash plate 67 is a snap fit in such opening. A rearwardly facing surface 91 of the splash plate 67 has a conical extension 92 centrally located thereon. A pair of diametrically opposed passageways 93 are formed through the conical extension 92 to connect with an aperture 94 formed in a forwardly facing surface 95 of the splash plate 67**.

During rotation of the atomizer bell 26 and the splash plate 67, coating fluid will exit the fluid nozzle 66 and spread over the surface of the conical extension 92. Under centrifugal force, the coating fluid will flow out onto the rearwardly facing surface 91 of the splash plate 67 and onto a rearwardly facing surface 96 of the atomizer bell 26. The fluid will then flow through passageway 97 which represents one of a plurality of such passageways equally spaced in a circular pattern and connecting the surface 96 to the forwardly facing surface of the atomizer bell. A small portion of the coating fluid will also flow through the passages 93 and into the aperture 94. This fluid will flow from the aperture 94 over the forwardly facing surface 95 of the splash plate 67 and onto the forwardly facing surface of the atomizer bell 26 toward the passageway 97. Therefore, a thin film of wet coating fluid will be maintained on the central portions of the atomizer bell 26 and splash plate 67 as an aid to cleaning those parts with solvent as well as the internal and external surfaces of the bell 26 which are wet when the coating job has been completed.

As shown in FIG. 2, one or more generally radially extending apertures 98 are formed in the outer surface of the shaping air ring 25. The aperture 98 are adapted to be engaged by a suitable tool for threading the ring 25 into and out of engagement with the cap 24. Similar apertures can be formed in the outer surface of the cap 24 for threading into and out of engagement with the manifold 49.

Figure 5:
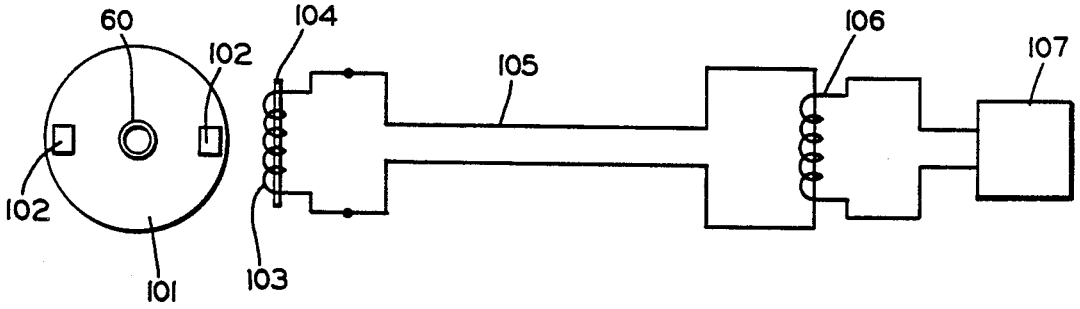
FIG. 5 is a schematic diagram of the speed sensor circuit of the rotary atomizer of FIG. 1.

FIG. 5 is a schematic diagram of the speed monitoring circuit for the rotary atomizer of FIG. 1. The motor 46 includes a turbine wheel 101 attached to the drive shaft 60. A pair of permanent magnets 102 are mounted at diametrically opposed locations on the turbine wheel. Although one magnet is sufficient to generate a speed signal, two or more magnets are typically utilized to maintain the balance of the turbine wheel 101. A pickup coil 103 including a magnetic core 104 is located adjacent the path of the magnet 102. The ends of the pickup coil 103 are connected to opposite ends of a single loop of dielectrically insulated high voltage wire 105 in a series loop. The pickup coil 103 and the magnetic core 104 are positioned inside the motor 46. The high voltage wire 105 extends through an aperture (not shown) formed in the end cover 48 and through the aperture 37 formed in the manifold body 29. Typically, the high voltage wire 105 extends approximately two or more feet from the rotary atomizer 20 and passes through the center of a toroidal coil 106. The ends of the isolation coil 106 are connected to a conventional speed monitoring device 107.

Each time one of the magnets 102 passes the pickup coil 103, an electrical pulse is generated in the coil 103 and is conducted through the high voltage wire 105. The pulse is inductively coupled to the toroidal coil 106 and is sensed by the speed monitoring device 107. The high voltage wire 105 and the toroidal isolation coil 106 provide high voltage isolation of the speed monitoring circuit from the high voltage power supply (not shown) which is connected to the rotary atomizer in a conventional manner to electrostatically charge the particles of coating fluid.

Figure 6:
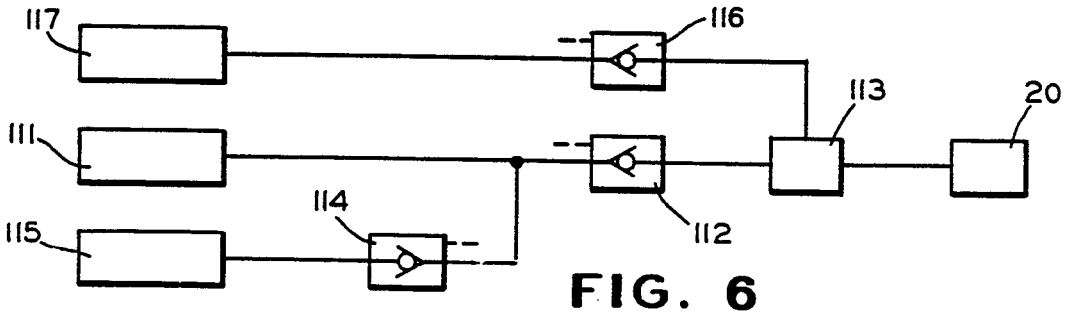
FIG. 6 is a schematic diagram of a valve system for the rotary atomizer of FIG. 1.

The fluid valve 61 and valve fluid assembly 62 shown in FIG. 2 can be utilized to control the flow of multiple colors of paint and cleaning solvent to the rotary atomizer 20. There is shown in FIG. 6 a schematic diagram of a valve control circuit in which a multiple color paint source 111 supplies paint to a rotary atomizer 20. The paint source 111 is conventional and typically includes a plurality of paint reservoirs, one for each color to be sprayed, connected through valves to a manifold. The outlet from the paint source 111 is in fluid communication with a valve 112 representing the combination of the fluid valve 61 and the valve fluid assembly 62 described above. The valve 112 in turn is in fluid communication with one inlet of an adapter 113 which has an outlet in fluid communication with the rotary atomizer 20. The outlet of the adapter 113 is threaded to engage the central aperture 31 formed in the manifold body 29.

Another valve 114 is connected between a dump reservoir 115 and the line between the paint source 111 and the valve 112. The valve 114 can be the combination of the fluid valve 61 and the valve fluid assembly 62. A similar valve 116 is connected between the adapter 113 and a source of solvent 117.

When the rotary atomizer 20 is being utilized to paint an object such as an automobile, the selected color of paint is forced under pressure from the paint source 111 through the valve 112 which is actuated to the open position under air pressure. The paint flows through the adapter 113 to the rotary atomizer 20. Typically, the next automobile body to be sprayed is to receive a different color of paint. The paint source 111 disconnects the color being utilized and injects a bead of solvent through the line toward the valve 112. However, the valve 112 is closed and the dump valve 114 is opened to the dump reservoir 115. Thus, the end of the color which has just been sprayed flows to the dump reservoir and the bead of solvent cleans the lines. The bead of solvent is followed by the new color to be sprayed and the timing is such that the dump valve 114 is not closed and the first valve 112 is not opened until the bead of solvent has passed and the second color is available to be directed to the rotary atomizer.

At the same time the color is being changed, the valve 116 is opened and a high pressure, short duration burst of solvent from the solvent reservoir 117 is forced through the adapter 113 and the rotary atomizer 20 to clean the paint flow path and the atomizer bell. The valve 116 is then closed before the valve 112 is reopened for the new color.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A rotary atomizer for spraying a coating fluid comprising:

a housing having an atomizer bell rotatably supported adjacent one end of said housing;

said atomizer bell including a generally cup-shaped member having an annular front flow surface which extends generally outwardly relative to an axis of rotation of said bell and which terminates at an outer edge portion from which the coating fluid is discharged, an annular splash plate secured within said cup-shaped member and defining a rear surface and a front surface, said rear surface having a central portion adapted to receive a supply of coating fluid and direct coating fluid from said central portion along said rear surface toward an outer portion of said splash plate, said central portion of said rear surface having a generally conical projection extending outwardly therefrom, first passage means extending through said outer portion of said splash plate for delivering coating fluid to said annular front flow surface of said cup-shaped member, and at least one second passage means extending straight through said splash plate for delivering a portion of the coating fluid to a central portion of said front surface of said splash plate, said second passage means having an inlet on said conical projection spaced from said axis;

feed tube means having one end connected to a source of coating fluid and an opposite end located on said axis adjacent said projection for delivering coating fluid thereto;

an annular shaping air cap secured relative to said one end of said housing and having an outer surface extending from said housing toward a peripheral portion of said bell; and an annular shaping air ring secured relative to said shaping air cap and having an inner surface in facing relationship with said outer surface of said air cap and extending toward said peripheral portion of said bell;

said outer surface of said air cap and said inner surface of said air ring cooperating to define a first annular chamber for receiving a supply of pressurized shaping air, an annular array of apertures for receiving such shaping air from said first chamber, a second annular chamber for receiving said shaping air from said first chamber through said apertures, and an annular space open adjacent said peripheral portion of said bell, said annular space receiving shaping air from said second chamber and directing such shaping air toward said peripheral portion of said bell in a thin uniform ring pattern.

2. A rotary atomizer according to claim 1 wherein said air cap is provided with a first threaded portion which engages a cooperating threaded portion of said housing and a second threaded portion which engages a cooperating threaded portion of said air ring.

3. A rotary atomizer according to claim 1 wherein the portions of said outer surface of said air cap and said inner surface of said air ring which cooperate to define said annular array of apertures includes contacting surface portions which function to maintain a predetermined spacing between the portions of said outer and inner surfaces defining said first and second chambers and said annular space.

4. A rotary atomizer according to claim 1 wherein said annular space is conically shaped to produce a conical ring of shaping air directed toward said rotational axis.

5. A rotary atomizer according to claim 4 wherein said annular conical space has a predetermined uniform spacing extending a predetermined distance along said axis.

6. A rotary atomizer according to claim 1 wherein one of said outer and inner surfaces has a plurality of spaced apart grooves formed therein which cooperate with the other one of said outer and inner surfaced to define said annular array of apertures.

7. A rotary atomizer for spraying a coating fluid comprising in combination a housing having an atomizer bell rotatably supported adjacent one end of said housing, an annular shaping air cap secured relative to said one end of said housing and having an outer surface extending from said housing toward a peripheral portion of said bell, an annular shaping air ring secured relative to said shaping air cap and having an inner surface in facing relationship with said outer surface of said air cap and extending toward said peripheral portion of said bell, said outer surface of said air cap and said inner surface of said air ring cooperating to define an annular space open adjacent said peripheral portion of said bell for receiving a supply of pressurized shaping air and for directing such shaping air toward said peripheral portion of said bell in a thin uniform ring pattern, said air cap and said bell cooperating to define a chamber therebetween, and means for supplying pressurized air to said chamber formed by said bell and said air cap for maintaining the pressure within said chamber at a predetermined positive pressure during the operation of said rotary atomizer, said chamber having an annular opening formed between said peripheral portion of said bell and an adjacent edge of said cap to enable pressurized air in said chamber to be exhausted therefrom between said peripheral edge and the opening from said annular space between said air cap and said air ring.

8. A rotary atomizer according to claim 7 wherein said means for supplying pressurized air to said chamber includes an air motor located in said housing for rotating said bell, said motor generating pressurized exhaust air.

9. A rotary atomizer according to claim 8 and further including a shroud surrounding said motor and said housing and wherein said motor includes an exhaust outlet located at one end of said motor and open to an interior of said shroud, and passage means located adjacent an opposite end of said motor for connecting said interior to said chamber such that exhaust air flows through said shroud from said exhaust outlet to said passage means over an exterior surface of said motor and said housing.

10. A rotary atomizer according to claim 7 and further including a motor located in said housing for rotating said atomizer bell, wherein said shaping air cap has one end threadably secured to one end of said housing, and a retainer ring having an inner portion retained by said housing and an outer portion retained by said cap for preventing separation of said cap from said housing.

11. A rotary atomizer according to claim 10 wherein said one end of said housing includes an external circumferential groove formed therein for retaining said inner portion of said retainer ring and wherein said cap has an internal circumferential groove formed therein for retaining said outer portion of said retainer ring.

12. A rotary atomizer according to claim 10 wherein an outer surface of said housing and an inner wall of said cap form a portion of a flow path for shaping air and a portion of a flow path for exhaust air and said retainer ring separates said shaping sir path portion from said exhaust air path portion.

13. A rotary atomizer according to claim 7 and further including an outer shroud surrounding said housing, a manifold including inlet means adapted to supply said pressurized source of shaping air and outlet means connected to said annular space, and fastener means for releasably securing said shroud to said manifold means.

* * * * *